United States Patent [19]

Stahlecker

[11] Patent Number: 4,916,777

[45] Date of Patent: Apr. 17, 1990

[54] RING MOUNTING FOR OPENING ROLLERS OF SPINNING MACHINES

[75] Inventor: Fritz Stahlecker, Bad Uberkingen, Fed. Rep. of Germany

[73] Assignee: Hans Stahlecker, Fed. Rep. of Germany; a part interest

[21] Appl. No.: 254,813

[22] Filed: Oct. 7, 1988

[30] Foreign Application Priority Data

Aug. 12, 1988 [DE] Fed. Rep. of Germany ..... 3827344

[51] Int. Cl.[4] ..... D01B 1/00; D01G 15/12

[52] U.S. Cl. ..... 19/97

[58] Field of Search ..... 19/97, 112, 114; 57/400, 408, 409, 411

[56] References Cited

U.S. PATENT DOCUMENTS 542,605 7/1895 Clay et al. ..... 19/114
2,340,221 1/1944 Hollingsworth ..... 19/97
3,391,429 7/1968 Watanabe ..... 19/114
4,606,095 8/1986 Egerer ..... 19/97
4,646,389 3/1987 Stahlecker et al. ..... 19/97

FOREIGN PATENT DOCUMENTS 3439664 10/1984 Fed. Rep. of Germany ..... 19/112

*Primary Examiner*—Werner H. Schroeder
*Assistant Examiner*—D. Price
*Attorney, Agent, or Firm*—Barnes & Thornburg

[57] ABSTRACT

In the case of a ring mounting for opening rollers of spinning machines having a ring-shaped basic body, out of the outer circumference of which a set of teeth is worked by means of notches extending essentially in axial direction and by means of grooves extending essentially in circumferential direction, it is provided that the grooves are deeper than the notches, the depth of the grooves amounting to 1.6 to 1.8 times the depth of the notches.

17 Claims, 1 Drawing Sheet

Fig. 1
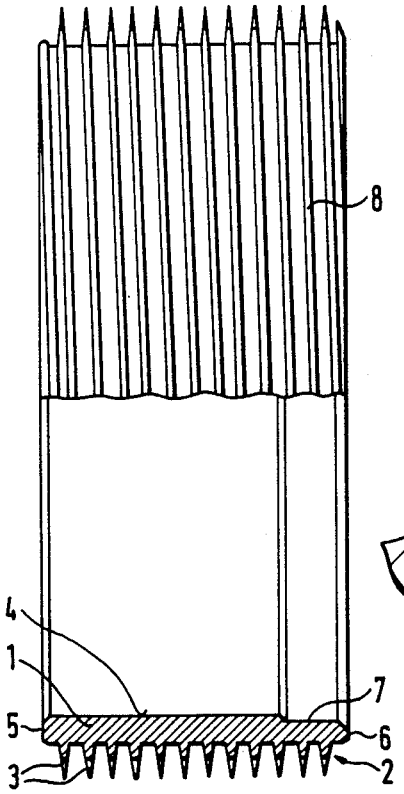
Fig. 2
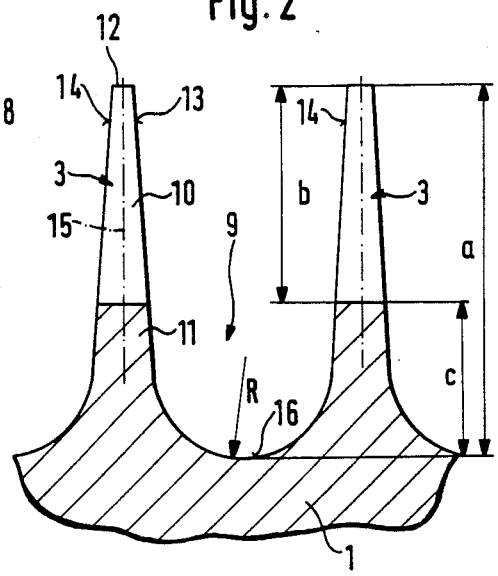
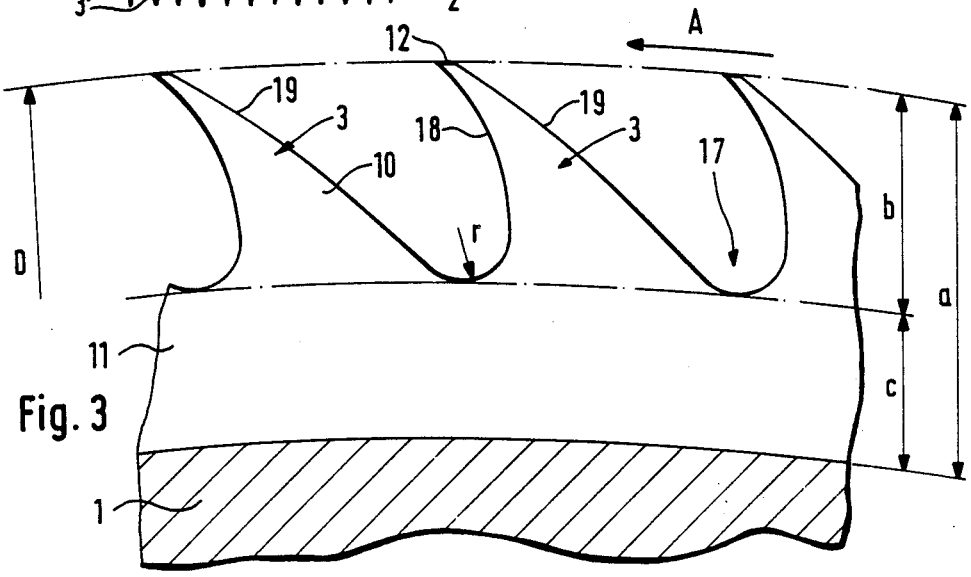
Fig. 3

RING MOUNTING FOR OPENING ROLLERS OF SPINNING MACHINES

BACKGROUND AND SUMMARY OF THE INVENTION

The invention relates to a ring mounting for opening rollers of spinning machines having a ring-shaped basic body. A set of teeth is worked out of the circumference of this ring-shaped basic body by means of notches extending essentially in axial direction and by means of grooves extending essentially in circumferential direction.

A ring mounting of the initially mentioned type, as described in, for example, German published application No. (DE-A) 34 39 664, permits a better adaptation of the individual teeth constructed in one piece with the ring mounting to the fiber material to be processed. In addition, it is possible to harden the teeth over their whole height.

Commonly assigned U.S. patent applications Ser. No. 237,330, filed Aug. 29, 1988 and based on German Application Nos. P 37 30 297.3 and Ser. No. 237,760, filed Aug. 29, 1988 and based on German Application No. P 37 30 295.7 also relate to ring mounting rollers of spinning machine.

An object of the invention is to improve the characteristics of a ring mounting of the initially mentioned type.

This object is achieved according to preferred embodiments of the invention by providing that the grooves are deeper than the notches.

These differences in depth are preferably produced by reducing the depth of the notches in contrast to the known construction while the depth of the grooves remains the same. By means of this construction, an improved fiber transport is achieved and the detaching of the fibers at the delivery point is also improved. The fibers winding themselves around the teeth having a higher base can penetrate less deep into the mounting. In the area of the detaching point, it is possible that these fibers are subjected to a flow of air coming out of the grooves and are detached more easily from the mounting. For the fibers located in the grooves and floating in the grooves, larger areas are created at which a taking-along can take place as a result of friction. Particularly advantageous results are obtained if the depth of the grooves amounts to 1.6 to 1.8 times the depth of the notches.

By means of saw-tooth wires, which are wound onto a ring under a roller body, a comparable mounting cannot be realized. These saw-tooth wires are first produced as straight wires which are wound onto the ring mounting with a relatively high tension. The diameter of the ring mounting is relatively small. As a result, a relatively high tension is created in the area of the tooth bases so that the height of the base of the tooth is inevitably limited.

In the case of saw-tooth wire mountings for cards, it was known (U.S. Pat. No. 3 391 429) to provide a base of the tooth that is very high in comparison to the overall height of the tooth. However, a saw-tooth wire of this type cannot be used on an opening roller because it cannot be wound around the relatively small diameter of a ring mounting of an opening roller. A winding-on of a saw-tooth wire of this type is possible only in the case of cards having at least 10 times the diameter of opening rollers so that a significantly lower bending occurs during the winding.

In a further development of the invention, it is provided that the teeth, in each case, have a tooth face that is curved forward. This tooth shape facilitates particularly the detaching of the fibers at a given point. The angle of the tooth face in the area of the base of the tooth can be kept relatively small with respect to a radial line so that the fibers which are bent around a tooth of this type can move relatively easily to the outside to the tip of the tooth. A fiber that has remained around the area of the tip of the tooth is nevertheless guided securely to the detaching point, because a relatively large positive angle exists here. In addition, an aggressive tooth tip is obtained in this manner which penetrates easily into the fiber material offered as a fiber beard and also combs it out better.

In a further development of the invention, it is provided that the bottom of the grooves, in their cross-section are approximately semicircular. As a result, a uniform air flow is obtained in the area of the bottom which promotes a good and secure fiber transport and also a reliable detaching in the area of the detaching point.

In a further development of the invention, it is provided that the lateral flanks of each tooth are inclined toward the radial line and approach one another in the direction of the tooth tips. Since the teeth are inclined on both sides, the detaching of the fibers is also facilitated.

Other objects, advantages and novel features of the present invention will become apparent from the following detailed description of the invention when considered in conjunction with the accompanying drawings.

BRIEF DESCRIPTION OF THE DRAWINGS

FIG. 1 is a simplified representation of a view of a ring mounting which is cut in half, constructed according to a preferred embodiment of the invention;

FIG. 2 is a very enlarged axial sectional view of the ring mounting of the FIG. 1 embodiment of the invention in the area of the teeth; and FIG. 3 is an also very enlarged radial sectional view of the ring mounting of the FIG. 1 embodiment of the invention in the area of the teeth.

DETAILED DESCRIPTION OF THE DRAWINGS

The ring mounting 1, on its outer circumference, is equipped with a set 2 of teeth, the teeth 3 of which are worked out of the ring mounting 1 by cutting, particularly by grinding. Grooves 9 are worked into the outer circumference of the ring mounting 1 which extend essentially in circumferential direction. These grooves 9 are worked into the outer circumference such that they form a spiral 8 having a flat slope. A plurality of notches 17 extending in axial direction are also worked into the outer circumference. The grooves 9 delimit the teeth 3 of the set 2 of teeth with respect to the lateral flanks 13, 14 forming lateral profiles 10. The notches 17 delimit the teeth 3 with respect to the tooth face 18 and the back 19 of the tooth. As shown in FIG. 3, the tooth face 18 of the teeth 3 is curved forward with respect to the rotating direction (A), the teeth 3, in the area of the bases 11 of the teeth, starting with an approximately radially directed tooth face 18 which, further on the outside, is sloped more toward the front. The transition between the back 19 of the preceding tooth 3 to the tooth face 18 of the tooth 3 that follows is uniformly rounded with a radius (r).

The lateral flanks 13, 14 of the teeth 3 extend with a slope toward the radial line 15, approaching one another in outside direction toward the tooth tip 12. The tip 12 of the tooth is slightly flattened. In the area of the tooth base 11, the lateral flanks 13, 14 change ridgelessly and smoothly into the side walls of the grooves 9 which are rounded with a relatively large radius (R) in the area of the bottom 16. As shown in FIG. 2, the bottom 16 has an almost semicircular cross-section.

As shown in FIGS. 2 and 3, the depth (a) of the grooves 9, in radial direction, is clearly deeper than the depth (b) of the notches 17. This results in tooth bases 11 in the form of a surrounding screw spiral of a height of (c). The depth (a) of the grooves 9 is 1.6 to 1.8 times larger than the depth (b). The outside diameter (D) of the ring mounting 1, in the area of the tooth tips 12, is 15 to 30 times and preferably 20 times larger than the depth (a) of the grooves 9. In a preferred embodiment, the outer diameter (D) of the ring mounting is 64 mm. The depth (a) of the grooves 9 amounts to 3.1 mm; the depth (b) of the notches 17 amounts to 1.8 mm. The thus obtained height of the tooth, or more precisely, the height of the tooth face 18 corresponds to the depth (b). This depth (b) is of an extent that has been comparable to that of saw-tooth wire mountings of opening rollers. The height (c) of the bases 11 of the teeth, however, is much larger than in the case of the known opening rollers wound with saw-tooth wire.

The ring mounting 1 has an inner cylindrical mounting surface 4 which extends from a radially extending end face 5 to a stepped recess configuration 6, 7 at the other opposite end face. See the above-noted copending application filed Aug. 29, 1988 and based on German Patent No. 37 30 297.3 for a description of corresponding ring mounting structure.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A ring mounting for opening rollers of spinning machines having a ring-shaped basic body, out of the outer circumference of which a set of teeth is integrally formed by means of notches extending essentially in axial direction and by means of grooves extending essentially in circumferential direction with said teeth being bounded by the respective notches and grooves, wherein the groves are deeper than the notches.

2. A ring mounting according to claim 1, wherein the depth (a) of the grooves amounts to 1.6 to 1.8 times the depth (b) of the notches.

3. A ring mounting according to claim 1, wherein the teeth each have a forwardly curved tooth face.

4. A ring mounting according to claim 2, wherein the teeth each have a forwardly curved tooth face.

5. A ring mounting according to claim 1, wherein the bottom of the grooves is approximately semicircular in its cross-section.

6. A ring mounting according to claim 4, wherein the bottom of the grooves is approximately semicircular in its cross-section.

7. A ring mounting according to claim 1, wherein lateral flanks of the teeth extend as a straight-line extension to lateral walls of the grooves.

8. A ring mounting according to claim 2, wherein lateral flanks of the teeth extend as a straight-line extension to lateral walls of the grooves.

9. A ring mounting according to claim 4, wherein lateral flanks of the teeth extend as a straight-line extension to lateral walls of the grooves.

10. A ring mounting according to claim 7, wherein lateral flanks of each tooth are sloped toward the radial line and approach one another in the direction toward located on outer ends of said teeth tooth tips.

11. A ring mounting according to claim 8, wherein lateral flanks of each tooth are sloped toward the radial line and approach one another in the direction toward located on outer ends of said teeth tooth tips.

12. A ring mounting according to claim 9, wherein lateral flanks of each tooth are sloped toward the radial line and approach one another in the direction toward located on outer ends of said teeth tooth tips.

13. A ring mounting according to claim 1, wherein the teeth exhibit tooth tips at radially outer ends thereof, and wherein the outside diameter (D) of the ring mounting in the area of the tooth tips amounts to 15 to 30 times the depth (a) of the grooves.

14. A ring mounting according to claim 2, wherein the teeth exhibit tooth tips at radially outer ends thereof, and wherein the outside diameter (D) of the ring mounting in the area of the tooth tips amounts to 15 to 30 times the depth (a) of the grooves.

15. A ring mounting according to claim 4, wherein the teeth exhibit tooth tips at radially outer ends thereof, and wherein the outside diameter (D) of the ring mounting in the area of the tooth tips amounts to 15 to 30 times the depth (a) of the grooves.

16. A ring mounting according to claim 5, wherein the teeth exhibit tooth tips at radially outer ends thereof, and wherein the outside diameter (D) of the ring mounting in the area of the tooth tips amounts to 15 to 30 times the depth (a) of the grooves.

17. A ring mounting according to claim 7, wherein the teeth exhibit tooth tips at radially outer ends thereof, and wherein the outside diameter (D) of the ring mounting in the area of the tooth tips amounts to 15 to 30 times the depth (a) of the grooves.

* * * * *